United States Patent [19]

Dabrowski

[11] Patent Number: 4,695,008

[45] Date of Patent: Sep. 22, 1987

[54] REELING MANDREL FOR WINDING METAL STRIPS

[76] Inventor: Henry Dabrowski, In der Meer 22a, 4005 Meerbusch 1, Fed. Rep. of Germany

[21] Appl. No.: 765,499

[22] Filed: Aug. 14, 1985

[30] Foreign Application Priority Data

Sep. 7, 1984 [DE] Fed. Rep. of Germany ..... 3432876

[51] Int. Cl.[4] ..... B65H 18/04; B65H 75/18

[52] U.S. Cl. ..... 242/68.5; 242/72 R; 242/78.1; 242/68

[58] Field of Search ..... 242/72 R, 78.1, 68, 242/68.1, 46.6, 68.5, 68.6; 226/186, 188–191; 100/163 R, 163 A; 29/132, 110 R; 474/190, 191

[56] References Cited

U.S. PATENT DOCUMENTS

| | | | |
|---|---|---|---|
| 2,332,293 | 10/1943 | Blodgett | 242/78.1 |
| 3,390,762 | 7/1968 | Mernieks | 242/68.5 |
| 3,786,549 | 1/1974 | Pott | 29/132 X |
| 4,021,001 | 5/1977 | Sproat | 242/68.5 |
| 4,583,272 | 4/1986 | Keller | 29/110 |

*Primary Examiner*—John M. Jillions
*Attorney, Agent, or Firm*—Browdy and Neimark

[57] ABSTRACT

In a reeling installation for winding metal strips, a drivable and spreadable reeling mandrel (2) is provided, upon which an exchangeable lining (5) made of elastomer material is arranged. A reeling mandrel lining of this type treats the strip to be wound or unwound gently and compensates the differences between the internal diameter of the coil (4) and the external diameter of the reeling mandrel (2). In order to create absolute protection for the strip starts of the coil in addition to these advantages, the elastomer material of the reeling mandrel lining (5) is made soft in the outer region as far as the outer surface of the lining. In the inner region as far as the inner surface of the lining on the other hand the elastomer material is made hard in order to ensure the necessary rigidity and dimensional stability of the lining. Consequently a gentle embedding of the strip start into the soft outer layer occurs, whereby marks in the convolution regions of the coil located above the strip start are prevented.

16 Claims, 3 Drawing Figures

REELING MANDREL FOR WINDING METAL STRIPS

The invention relates to a reeling installation for winding metal strips with a drivable, spreadable reeling madrel upon which an exchangeable lining made of elastomer material is arranged.

Reeling mandrel linings made of elastomer material are used, both for winding and for unwinding coils, in the strip processing and strip finishing industry. These reeling madrel linings serve on the one hand to compensate the differences between the internal diameter of the coil and the external diameter of the reeling mandrel, and on the other hand to protect the strips from attack by the hard cheeks of the reeling madrel. The reeling mandrel linings used exhibit a hardness of approximately 70 Shore A, which provides the required stiffness when being pushed onto the mandrel on the one hand, and ensures a certain protection for the metal strip on the other hand.

However, in recent years the qualitative requirements for the strips have become constantly more stringent. It is a further disadvantage, particularly in the case of sensitive strips, that the edge of the strip start makes a mark through several convolutions of the coil, whereby a scrap end results on the coil, which is a disadvantage particularly in the case of high-grade material.

The underlying aim of the invention is to develop further a reeling installation of the generic type so that, whilst maintaining the previous advantages, an absolute protection is created for the strip starts of the coil.

This aim is achieved according to the invention in that the elastomer material of the reeling mandrel lining is hard in the inner region as far as the inner surface of the lining, and soft in the outer region as far as the outer surface of the lining.

Due to the measure according to the invention, a gental embedding of the strip start into the soft outer layer of the reeling mandrel lining occurs, whereby marks in the convolution regions of the coil located over the strip start are prevented. The rigidity of the reeling mandrel lining, and particularly a smooth firm inner surface of the lining, is ensured by the hard inner layer.

The reeling mandrel lining may be composed of two layers, namely an inner hard layer and an outer soft layer, the thickness of the hard inner layer being approximately one third of the material thickness of the reeling mandrel lining, and that of the outer layer being approximately two thirds of the material thickness of the reeling mandrel lining.

However, the reeling mandrel lining may also be composed of three of more layers which become softer from the inside outwards. By this multi-layer construction it is possible to avoid hardness jumps, so that no extreme stress peaks which might endanger the multi-layer construction occur at the transitions of elasticity modulus. By this means a mechanically stable structure is achieved, in which the gravity forces are considerably reduced in the boundary layers between the individual layers.

The individual layers of the construction are preferably mutually connected by vulcanisation, whereby a firm and intimate cohesion of the layers is achieved.

The inner layer of the reeling mandrel lining preferably exhibits a hardness of 70–80 Shore A, whereas the outer layer is provided with a hardness of 40–60 Shore A, preferably of 50–55 Shore A.

In the case of the known reeling mandrel linings, it was frequently necessary for the outsides to be slit in order to reduce the spreading force. This is no longer necessary in the majority of cases with the reeling mandrel lining according to the invention. The production of the reeling mandrel linings can be simlified due to the elimination of the slits.

The invention is illustrated by way of example in the drawing and described in detail below with reference to the drawing, wherein.

Figure 1:
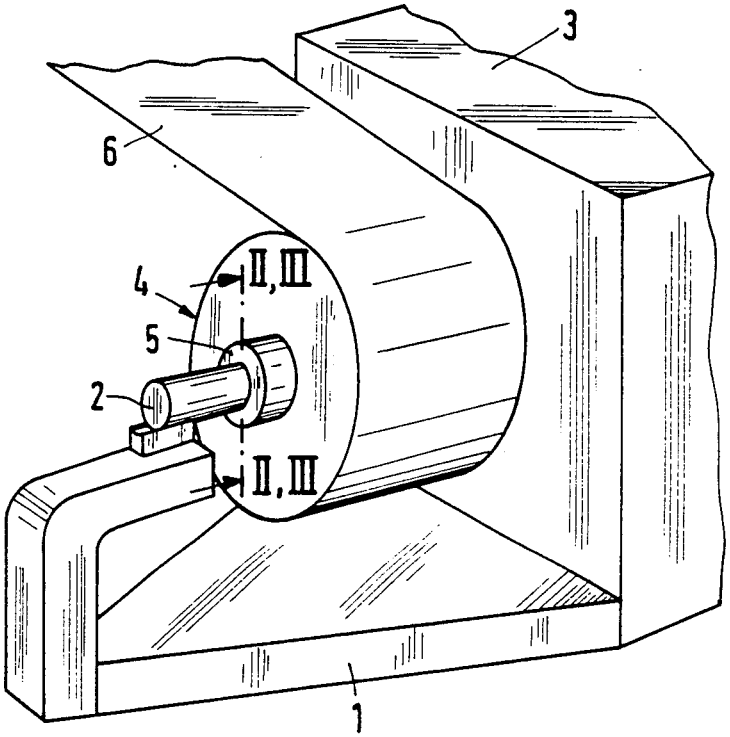
FIG. 1 shows in a perspective view a reeling installation, in which the reeling mandrel is provided with a lining.

As shown in the drawing, a reeling installation comprises a machine frame 1 with a drivable, spreadable reeling mandrel 2 which is supported on both sides. The drive means for the reeling mandrel is located in the right-hand housing part 3. A one-sided mounting of the reeling mandrel would also be sufficient for specific applications.

The reeling mandrel 2 exhibits in its central regions, which serves to accommodate a metal strip coil 4, a lining 5 which consists of elastomer material and is wider than the metal strip 6.

Figure 2:
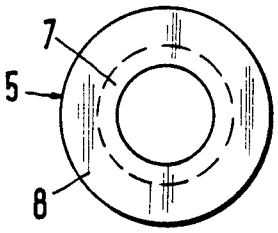
FIG. 2 shows in a view on a larger scale a section through the reeling mandrel lining along the line II—II from FIG. 1.

According to FIG. 2 the reeling mandrel lining 5 is composed of two layers made of elastomer material, namely a hard inner layer 7 and an outer soft layer 8, which are vulcanised together in their boundary region. The thickness of the harder inner layer 7 is approximately one third of the material thickness of the reeling mandrel lining 5, and the soft outer layer 8 two thirds of the material thickness.

The hard inner layer, which generates the necessary self-rigidity and therefore facilitates the placing onto the reeling mandrel 2, exhibits a hardness of 70–80 Shore A, whereas the outer soft layer 8 is provided with a hardness of approximately 50–55 Shore A. By this means the reeling mandrel lining 5 is given an adequately soft surface, into which the respective strip end can embed itself, and therefore does not leave a mark on the coil convolutions located above it.

Figure 3:
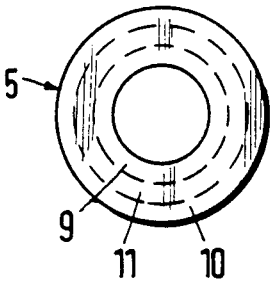
FIG. 3 shows a similar section to FIG. 2 through another exemplary embodiment of a reeling mandrel lining.

In the embodiment of the reeling mandrel lining 5 illustrated in FIG. 3 three layers are provided, of which the inner layer 9 corresponds in hardness approximately to the layer 7 of the embodiment illustrated in FIG. 2, and the soft outer layer 10 exhibits approximately the same hardness as the outer layer 8. The intermediate layer 11, which is approximately of equal thickness to the inner layer 9 and the outer layer 10, is connected to the two adjoining layers 9 and 10 by vulcanisation and exhibits a hardness which lies between those of the inner and outer layers. Consequently the hardness jumps in the boundary layers are only slight, so that stress peaks can be prevented.

Apart from the fact that the outer soft layers 8 or 10 of the reeling mandrel lining have a gentle effect upon the strip material, and that scrap is very largely avoided even in the case of sensitive strips, the outer soft rubber layers also adapt themselves better to the prescribed contours. Furthermore, the soft outer layers exhibit higher frictional values, so that advantages, particularly as regards better nonpositive engagement, are also achieved in service during a winding or unwinding of a strip. Lastly, the assembly and dismantling of the reeling mandrel linings are also facilitated by the extremely hard inner layers, because the inner contour of the linings exhibits good dimensional stability.

I claim:

1. A reeling installation for winding metal strips with a drivable reeling mandrel, comprising:

an exchangeable lining of elastomer material mounted on said reeling mandrel, said lining of elastomer material being hard and flexible in the inner region as far as the inner surface of the lining, and soft and flexible in the outer region as far as the outer surface of the lining;

wherein the elastomer material of the inner region is sufficiently flexible to allow said lining to be useable on a reeling mandrel of the spreadable type.

2. The reeling installation according to claim 1, wherein said reeling mandrel lining comprises two layers, an inner hard layer and an outer soft layer, said two layers being mutually connected by vulcanization.

3. The reeling installation according to claim 2, wherein the thickness of the inner layer is approximately one third of the material thickness of the reeling mandrel lining, and the thickness of the outer layer is approximately two thirds of the material thickness of the reeling mandrel lining.

4. The reeling installation according to claim 2, wherein the layers are mutually connected by vulcanization.

5. The reeling installation according to claim 2, wherein the inner layer exhibits a hardness of 70 to 80 Shore A.

6. The reeling installation according to claim 2, wherein the outer layer exhibits a hardness of 40 to 60 Shore A.

7. The reeling installation according to claim 7, wherein the outer layer exhibits a hardness of 50 to 55 Shore A.

8. The reeling installation according to claim 1, the external surface of the reeling mandrel lining is smooth.

9. A reeling installation for winding metal strips with a driveable reeling mandrel, comprising:

an exchangeable lining of elastomer material mounted on said reeling mandrel, said lining elastomer material being hard in the inner region as far as the inner surface of the lining, and soft in the outer region as far as the outer surface of lining;

wherein the reeling mandrel lining comprises at least three layers, the hardness of said lining decreasing from the inside outwards.

10. The reeling installation according to claim 9, wherein the layers are mutually connected by vulcanization.

11. The reeling installation according to claim 9, wherein the inner layer exhibits a hardness of 70 to 80 Shore A.

12. The reeling installation according to claim 9, wherein the outer layer exhibits a hardness of 40 to 60 Shore A.

13. The reeling installation according to claim 12, wherein the outer layer exhibits a hardness of 50 to 55 Shore A.

14. In a reeling installation for winding metal strips on a reeling mandrel, the improvement wherein the installation further includes, mounted on the reeling mandrel:

an elastomeric sleeve, said sleeve having a first, inner annular flexible region and a second, outer annular flexible region disposed concentrically about said first annular region, said inner annular region having a hardness greater than the hardness of said outer annular region, the outermost surface of said outer annular region being sufficiently soft to permit a starting end of the metal strip to embed itself therein, whereby when the metal strip is wound on the reeling mandrel, the embedding of the starting end of the metal strip into said outermost surface of said outer annular region will prevent the formation of marks on successive layers of the coil located above the starting end of the metal strip.

15. The reeling installation of claim 14, wherein said second, outer annular region comprises at least two annular layers with the outermost annular layer having a hardness less than the hardness of any other layer.

16. The installation of claim 14, wherein the inner annular region of the elastomeric sleeve is sufficiently flexible to allow its use on a spreadable reeling mandrel.

* * * * *